US008963038B2

(12) United States Patent
Pope

(10) Patent No.: US 8,963,038 B2
(45) Date of Patent: Feb. 24, 2015

(54) HIGH VOLTAGE RELAY NON MERCURY

(76) Inventor: Stoss Kommen Pope, Waverly, OH (US)

( * ) Notice: Subject to any disclaimer, the term of this patent is extended or adjusted under 35 U.S.C. 154(b) by 267 days.

(21) Appl. No.: 13/236,492

(22) Filed: Sep. 19, 2011

(65) Prior Publication Data

US 2013/0068728 A1 Mar. 21, 2013

(51) Int. Cl.
*H01H 33/34* (2006.01)
*H01H 33/32* (2006.01)
*H01H 50/16* (2006.01)

(52) U.S. Cl.
CPC ..... *H01H 33/32* (2013.01); *H01H 50/163* (2013.01)
USPC ..... 218/154; 218/93; 218/142

(58) Field of Classification Search
USPC ..... 218/154, 142, 93
See application file for complete search history.

(56) References Cited

U.S. PATENT DOCUMENTS 3,171,000 A * 2/1965 Yeckley et al. ..... 200/82 B
3,489,951 A * 1/1970 Greenwood et al. ..... 361/4
4,074,096 A * 2/1978 Romanowski ..... 200/83 D
4,095,458 A * 6/1978 Wild ..... 73/73
4,104,689 A * 8/1978 Rohner ..... 361/44
4,105,878 A * 8/1978 Date et al. ..... 218/10
4,241,373 A * 12/1980 Mara et al. ..... 361/92
4,491,018 A * 1/1985 Stringer et al. ..... 73/865.8
4,617,855 A * 10/1986 Wrobleski et al. ..... 92/5 R
4,855,545 A * 8/1989 Kreuter ..... 200/81.4
5,818,003 A * 10/1998 Moldovan et al. ..... 218/26
5,866,864 A * 2/1999 Mody et al. ..... 218/38
5,874,873 A * 2/1999 Hetzmannseder et al. ..... 335/16
6,262,384 B1 * 7/2001 Niebler et al. ..... 218/156
6,300,586 B1 * 10/2001 Doughty et al. ..... 218/148
8,368,492 B1 * 2/2013 Theisen et al. ..... 335/201

* cited by examiner

*Primary Examiner* — Truc Nguyen

(57) ABSTRACT

The high voltage relay consists of a main body (1). One set of electrical contacts (2*a*, 2*b*) upper and lower respectively. High voltage connections to connect the voltage being switched (3*a*, 3*b*) are electrically connected to the upper and lower contacts respectively. Several size options for the electrical contacts will allow for a wide range of currents. A cylinder (4) driven by a fluid (e.g. Air, Nitrogen, Hydraulic fluid) moves the electrical contacts together during the ON state of the device. During the OFF state of the device the cylinder moves the electrical contacts apart to isolate the switch voltage. The greater the High Voltage being switched the greater the distance the electrical contacts must be moved apart in the OFF state. The cylinder is supplied the fluid power from a small solenoid (5) on the device. This solenoid has control voltage connections to actuate the device.

1 Claim, 2 Drawing Sheets

HIGH VOLTAGE RELAY NON MERCURY

CROSS-REFERENCE TO RELATED APPLICATIONS

Not Applicable

FEDERALLY SPONSORED RESEARCH

Not Applicable

SEQUENCE LISTING OR PROGRAM

Not Applicable

BACKGROUND OF THE INVENTION—FIELD OF INVENTION

And electromechanical relay for switching high voltage without the use of Mercury.

Background of the Invention

The high voltage relay consists of a main body (1), to which all the other components are mounted. One set of electrical contacts (2*a*) and (2*b*) upper and lower respectively. High voltage connections to connect the voltage being switched (3*a*) and (3*b*) are electrically connected to the upper and lower contacts respectively. Several size options for the electrical contacts will allow this product to handle low currents from less than 1 Amp to currents exceeding 600 amps. A cylinder (4) driven by a fluid (e.g. Compressed Air, Compressed Nitrogen, Hydraulic fluid) moves the electrical contacts together during the ON state of the device. During the OFF state of the device the cylinder moves the electrical contacts apart to isolate the switch voltage. The distance of the electrical contacts during the OFF state is determined by the stroke of the cylinder. The greater the High Voltage being switched the greater the distance the electrical contacts must be moved apart in the OFF state. The cylinder is supplied the fluid power from a small solenoid (5) on the device. This solenoid has control voltage connections to actuate the device.

Multiple contacts may be controlled by one cylinder for multiple contact applications such as but not limited to three phase motor connections.

The following are aspects of the device that will change to offer a complete line of these High Voltage Relays.

- Electrical contact (2*a*, 2*b*) and connection (3*a*, 3*b*) size will determine the amount of electrical current the relay is capable of conducting.
- The size of the cylinder (4) will determine the contact separation in the OFF state and determines the highest voltage the relay can switch off.
- The control voltage of the solenoid (5) will allow the end user to use whatever control voltage currently in use in their facility.
- The configuration of the solenoid connections to the cylinder will allow for a Normally Open and a Normally Closed configuration.

BACKGROUND OF THE INVENTION—OBJECTS AND ADVANTAGES

Accordingly, several objects and advantages of the present invention are:

(a) to provide a electrical mechanical relay capable of switching high voltage;

(b) to eliminate the need for Mercury in the high voltage switch applications, eliminating the health and environmental hazards associated with Mercury;

(c) to provide a high voltage switch for a wide range of high voltages;

(d) to provide a high voltage switch for a wide range of control voltages;

Further objects and advantages are to provide a durable and cost effective solution for the switching of high voltage while eliminating the need for Mercury.

SUMMARY

In accordance with the present invention the high voltage relays uses an air cylinder to move the electrical contacts together and apart with enough separation to isolate the selected high voltage for each application. The body completely encloses the electrified components preventing the arcing of the high voltage to other components in the same control panel.

DRAWINGS—FIGURES

DRAWINGS—REFERENCE NUMERALS

1 switch body
2*a* upper electrical contact
2*b* lower electrical contact
3*a* upper electrical connection
3*b* lower electrical connection
4 cylinder
5 solenoid valve

DETAILED DESCRIPTION—FIGS. 1, 2 AND 3—PREFERRED EMBODIMENTS

Figure 1:
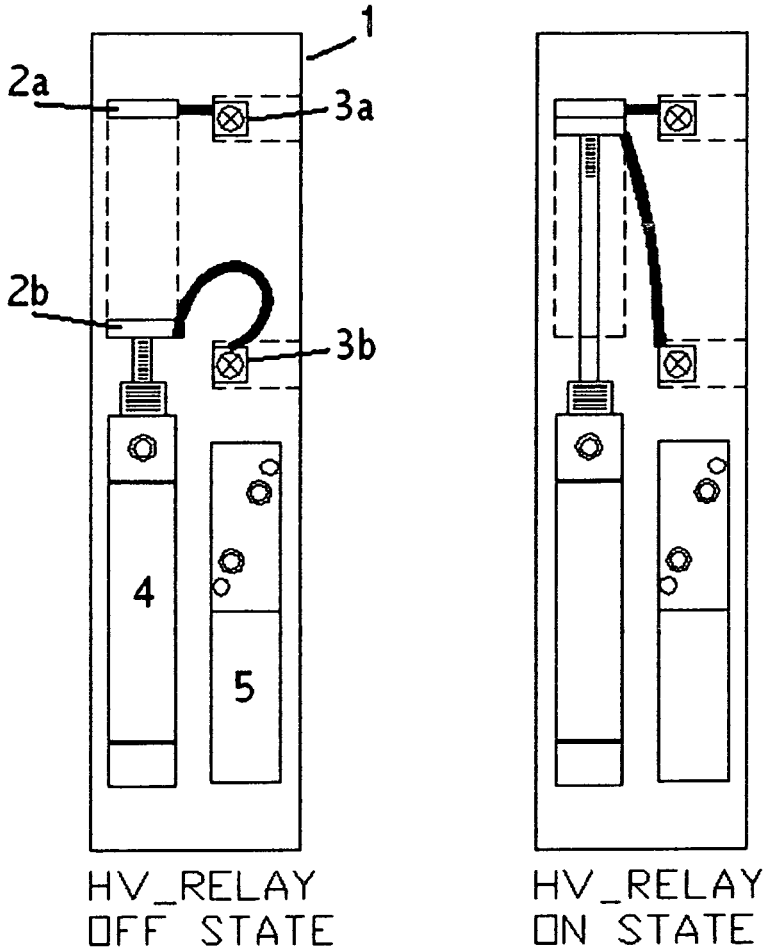
FIG. 1 shows the two dimensional view of the high voltage switch in the on and off state.

A preferred embodiment of the high voltage relay of the present invention is illustrated in FIG. 1 on Left (open view) and FIG. 1 Right (closed view). In the preferred embodiment, the two body (1) is made of an electrical insulation plastic. The electrical contacts (2*a*, 2*b*) will be made of electrical conductive metal and will vary in size depending on the rated current of the device. The electrical connections (3*a*, 3*b*) will be made of electrical conductive metal and will vary in size depending on the rated current of the device. The cylinder (4) is a commercially available cylinder operated by a compressed gas such as but not limited to Air or Nitrogen. The size of the cylinder will vary depending on the high voltage range to be isolated. The solenoid valve (5) is a commercially available solenoid control valve. The control voltage of this valve will be selected to offer a wide range of control voltages on the high voltage relay.

Figure 2:
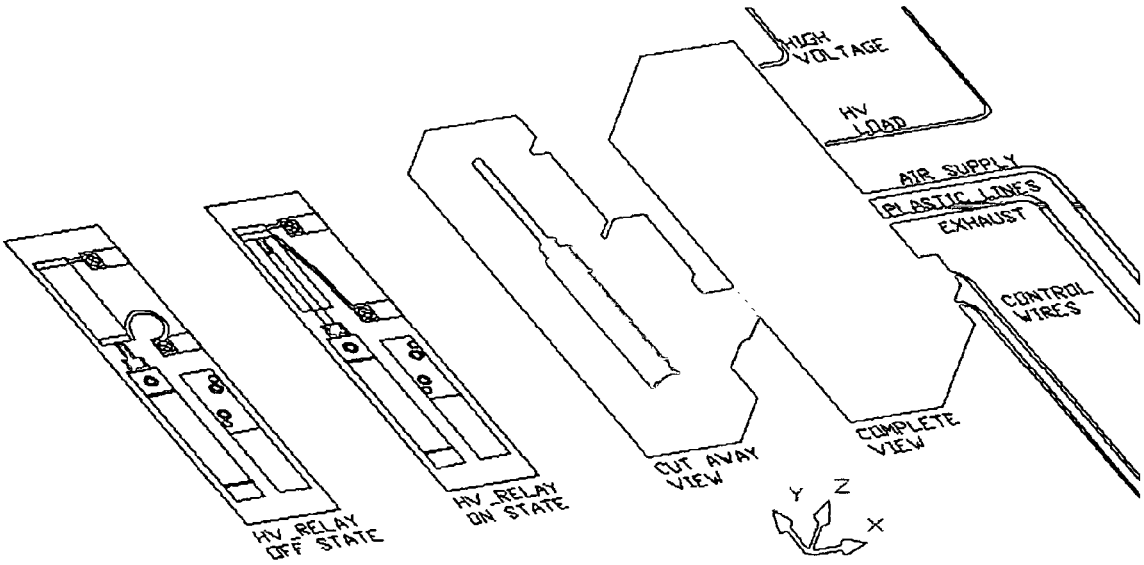
FIG. 2 shows the isometric view of the high voltage switch with a cut away view and a complete view. In addition the application connections are shown to the complete view.

Operation—FIGS. 1, 2

When the control voltage is applied to the solenoid valve (5) the solenoid valve sends the compressed gas to the other side of the cylinder (4) causing the cylinder (5) to switch positions from open to closed or from closed to open depending on the configuration. This allows the offering of a normally open or normally closed option. When the cylinder is extended the electrical contacts (2*a*, 2*b*) will complete the electrical circuit from the electrical connections (3*a*) to (3*b*).

When the cylinder (4) is retracted the electrical contacts (2*a*, 2*b*) are separated by the stroke length of the cylinder (4) allowing for the isolation of the high voltage.

All of this is accomplished without the use of Mercury.

Conclusion, Ramifications, and Scope

Accordingly, the use of this high voltage switch will allow for many high voltage applications to be solved without the use of hazardous materials such as Mercury.

Although the description above contains many specificities, these should not be construed as limiting the scope of the invention but as merely providing illustrations of some of the presently preferred embodiments of this invention.

Thus the scope of the invention should be determined by the appended claims and their legal equivalents, rather than by the example given.

I claim:

1. A high voltage relay to switch high voltage on and off which comprises:

a molded electrically insulating body having a chamber;

a set of electrical contacts electrically connected to a set of high voltage electrical connections;

the contacts are enclosed in the insulating body within the chamber to allow the contacts to connect for an on position and separate for an off position;

the high voltage electrical connections are accessible through the insulating body.

* * * * *